US005082060A

United States Patent [19]

Johnson, Charles S. et al.

[11] Patent Number: 5,082,060

[45] Date of Patent: Jan. 21, 1992

[54] SUBSEA WELL HANGER

[75] Inventors: Johnson, Charles S., London; Robert Hart, Northolt, both of England

[73] Assignee: National-Oilwell (U.K.) Limited, Aberdeen, Scotland

[21] Appl. No.: 464,809

[22] Filed: Jan. 16, 1990

[30] Foreign Application Priority Data

Jan. 18, 1989 [GB] United Kingdom ..... 8901042

[51] Int. Cl.[5] ..... E21B 33/043

[52] U.S. Cl. ..... 166/339; 166/208; 166/237; 166/368

[58] Field of Search ..... 166/208, 351, 356, 339, 166/368, 237; 285/133.2, 137.2, 140, 141, 142, 143

[56] References Cited

U.S. PATENT DOCUMENTS

| | | | |
|---|---|---|---|
| 3,669,472 | 6/1972 | Nadsady | 285/348 X |
| 3,693,714 | 9/1972 | Baugh | 166/85 X |
| 3,721,292 | 3/1973 | Ahlstone | 166/268 X |
| 3,897,823 | 8/1975 | Ahlstone | 166/182 X |
| 4,422,507 | 12/1983 | Reimert | 166/348 |
| 4,528,738 | 7/1985 | Galle, Jr. | 285/3 X |
| 4,540,053 | 9/1985 | Baugh et al. | 166/348 |
| 4,550,782 | 11/1985 | Lawson | 166/88 X |
| 4,607,865 | 8/1986 | Hughes | 285/321 X |
| 4,714,111 | 12/1987 | Brammer | 166/182 |

*Primary Examiner*—Ramon S. Britts
*Assistant Examiner*—Roger J. Schoeppel
*Attorney, Agent, or Firm*—R. J. Bunyard; L. A. Fillnow; R. H. Johnson

[57] ABSTRACT

A hanger comprising two tubular sections, one partially received within the other, one section having a serrated surface and the other section retaining at least one detent whereby the axial length of the hanger is adjustable. This arrangement obviates the disadvantage in the conventional tie-back method of sub-sea wellhead completion wherein it is necessary to cut and dress the casing after pulling tension in the casing string.

6 Claims, 4 Drawing Sheets

SUBSEA WELL HANGER

BACKGROUND OF THE INVENTION

The present invention relates to a hanger, such as a casing hanger, as may be used when completing a previously drilled sub-sea well.

Frequently, when a sub-sea well has been drilled and initial investigation undertaken, the sub-sea wellhead will be blanked off and left for completion at a later date. When it is desired to complete the well, a surface wellhead is moved into position and the appropriate tubing and casing is installed between the sub-sea and surface wellheads. It is usually desirable to avoid the weight of this interconnecting tubing and casing from bearing on the sub-sea wellhead. Consequently, once the hangers have been attached to the sub-sea wellhead they are pulled in tension and tied back to the surface wellhead. The tie-back is normally achieved by inserting slips between the tubing and casing hangers and the surface wellhead.

This conventional arrangement has the serious disadvantage of requiring the interconnecting hangers, after tie-back, to be cut and dressed such that they are of the correct axial length to cooperate properly with the surface wellhead, via a pack-off assembly.

SUMMARY OF THE INVENTION

With a view to obviating the above mentioned disadvantage, the present invention provides a hanger comprising two tubular sections one received at least partially within the other, one section carrying a serrated surface and the other retaining at least one complementary detent whereby the axial length of the hanger is adjustable.

Preferably, the detent is in the form of the split ring and more prefereably the serrated surface is in the form of a thread, with the split ring carrying a complementary thread.

Beneficially the split ring is retained on the respective tubular section by a recess formed in that section, the recess being axially more extensive than the split ring. It is preferred that the recess has portions of two different radial depths which provide for radial movement of the split ring.

Advantageously, the tubular section received within the other tubular section carries a ferrule and a seal, the ferrule being movable relative to the said section so as to actuate the seal which seals between the two sections.

It is preferred that the serrated surface is provided on the section received within the other section. It is also preferred for the serrated surface to be in the form of a back taper angle thread.

The present invention provides an adjustable arrangement whereby the need to cut and dress casing when completing a previously drilled sub-sea well can be obviated.

BRIEF DESCRIPTION OF THE DRAWINGS

Embodiments of the present invention will now be described in detail, by way of example only and with reference to the accompanying drawings, in which.

DESCRIPTION OF PREFERRED EMBODIMENTS OF THE INVENTION

Figure 1:
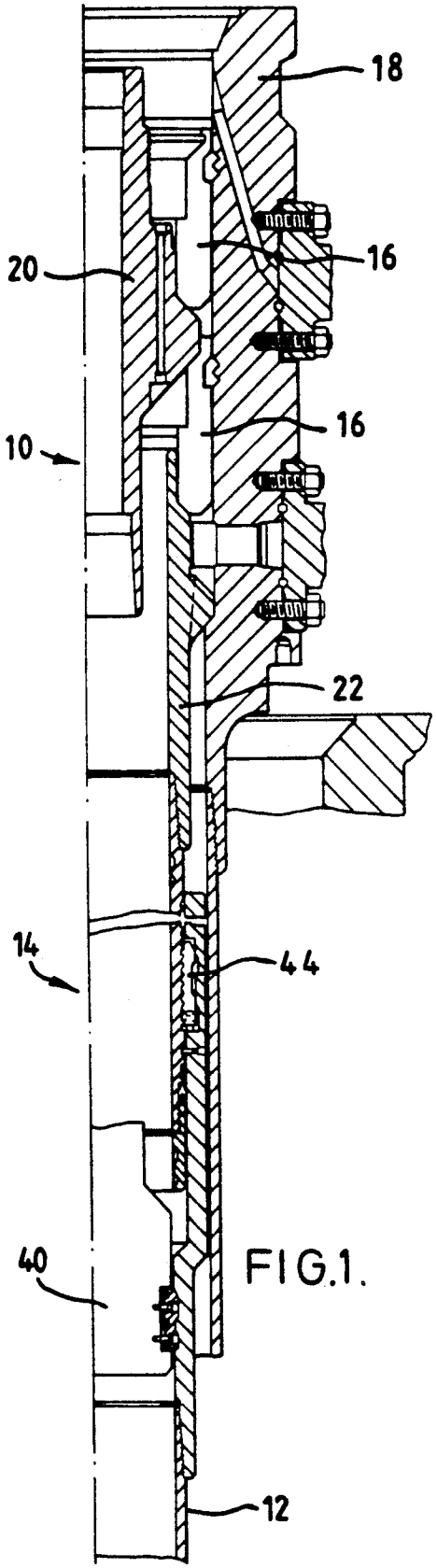
FIG. 1 is a partial vertical sectional showing a casing hanger in accordance with the present invention and in situ between a surface wellhead and casing which extends to the sub-sea wellhead (not shown).

FIG. 1 illustrates the surface wellhead 10 interconnected to casing 12 which rises from the sub-sea wellhead (now shown) by means of the adjustable hanger 14 which embodies the present invention. From FIG. 1 it will be readily apparent that the adjustable axial length of hanger 14 enables the surface wellhead 10 to be readily made up. That is, the wellhead 10 can be made up using conventional pack-offs 16 between the wellhead housing 18 and the internal components, for example tubing hanger 20. The arrangement avoids the requirement to cut and dress the casing, normally attached to hanger 22, which is unavoidable with the conventional tie-back system. It is to be noted that all of the benefits of the tie-back system are retained.

Figure 2:
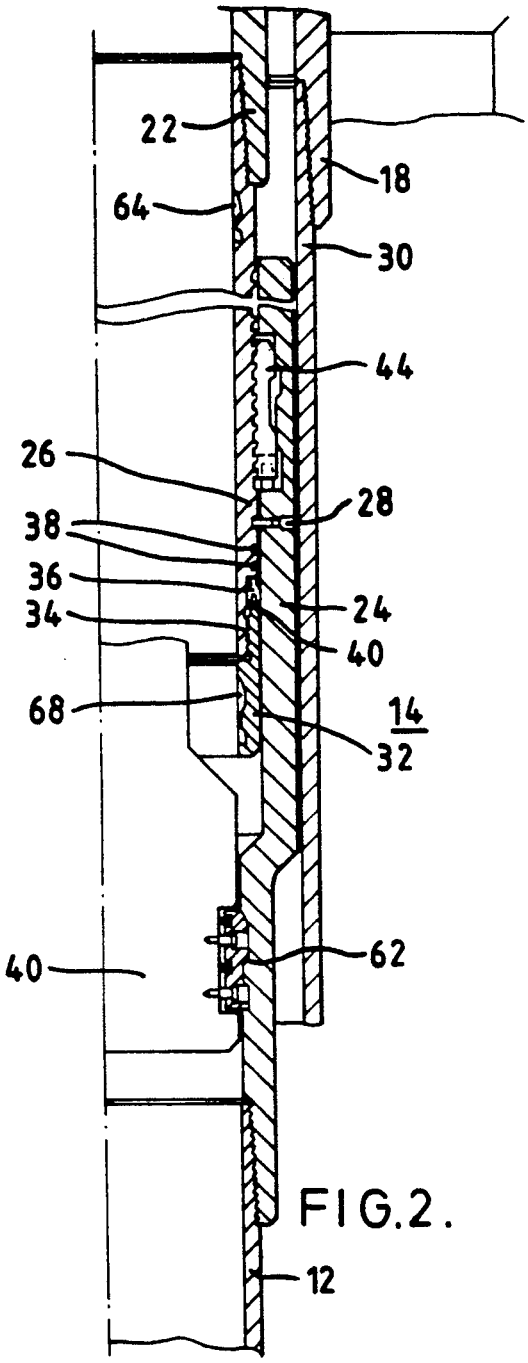
FIG. 2 shows to an enlarged scale the casing hanger in accordance with the present invention which is shown in FIG. 1.

The hanger 14 is shown to an enlarged scale in FIG. 2. The main components of hanger 14 are an outer tubular section 26 is partially received within outer tubular section 24. Prior to installation in the casing string, sections 24 and 26 are held relative to each other by a number of cicumferentially located shear pins 28, of which one is shown in FIG. 2. In situ, the outer section 24 is threadedly engaged with casing 12 and the inner section 26 is threadedly engaged with the casing hanger 22. The surface wellhead housing 18 carries a protective sleeve 30 which covers the axial extent of possible relative motion between the tubular sections 24 and 26; in order to reduce the possibility of debris becoming trapped between the sections.

At its lower end, inner section 26 carries a ferrule 32, the components being joined by a thread 34. Ferrule 32 actuates the seal 36, in a manner to be described, so as to provide a seal between inner section 26 and outer section 24. Sealing bewteen the sections 24 and 26 is assisted by two O-rings 38. A tool 40 is shown in engagement with outer section 24 and the purpose and oepration of tool 40 will be described later.

Figure 3:
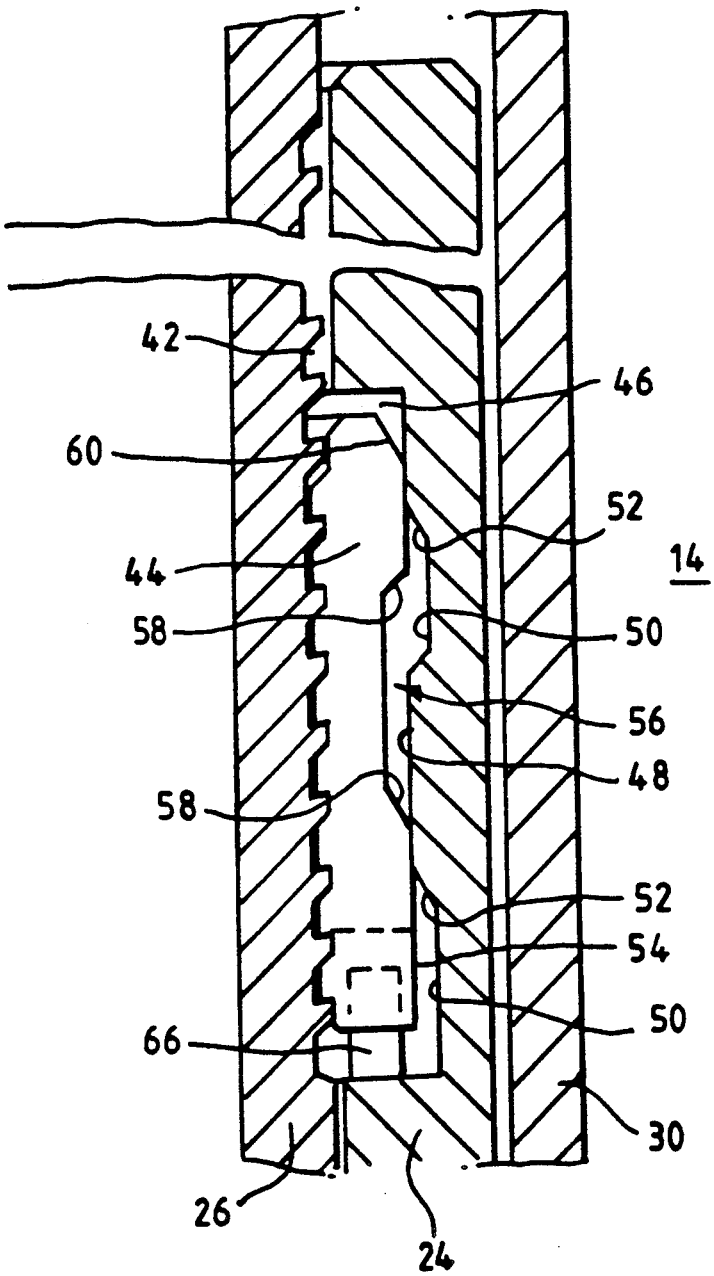
FIG. 3 illustrates to a still further enlarged scale the serrated surface and detent of the adjustable hanger.

As best seen in FIG. 3, inner tubular section 26 carries a serrated surface 42 and outer tubular section 24 carries a detent 44. In the illustrated embodiment, the serrated surface 42 is in the form of a back taper angle thread and detent 44 is in the form of a split ring which has a complementary thread to surface 42. Split ring 44 is retained by a recess 46 provided on the inner surface of tubular section 24. Recess 46 has an axial surface 48 with two hollows 50 provided therein.

The hollows 50 extend radially into section 24 from surface 48. At least the uppermost shoulder 52 of each hollow 50 is inclined at an angle, preferably 45°, with respect to the longitudinal axis of the hanger. The radially outer most surface 54 of split ring 44 is provided with a hollow 56 which extends radially inwards, back into the split ring 44.

The shoulders 58 of hollow 56 are inclined, preferably at an angle of 45°, with respect to the longitudinal axis of the hanger. The upper outer edge of the split ring 44 is provided with a similarly inclined chamfer 60.

Split ring 44 has a natural resilience which causes it to grip section 26. Hollows 50 and 56 are dimensioned such that the split ring, when forced to expand in the manner described hereinafter, can be accommodated in recess 46, with surfaces 58 and 60 in contact with surfaces 52. In this position, the lands of the thread just touch. Recess 46 is axially more extensive than split ring 44 and the split ring is only able to expand into recess 46 when the ring 44 is in contact with the lower axial end of recess 46.

Split ring 44 is prevented from rotating by one or more keys 66. Key 66 projects upwardly from the lower axial annular surface of recess 46 into a corresponding aperture in ring 44. The arrangement is dimensioned to allow for the radial movement of ring 44 within recess 46.

Installation and adjusment of hanger 14 will now be described.

With sections 24 and 26 held relative to each other by shear pins 28, hanger 14 is located on the casing 12. A torque tool 40 (shown in FIGS. 1 and 2) is engaged with section 24, via drive socket 62, whereby hanger 14 is rotatably engaged with casing 12, or hanger 14 and casing 12 are rotatably engaged with further sub-sea wellhead components (not illustrated). At this stage split ring 44 tightly grips section 26 and is only partially received in recess 46, although hollows 50 and 56 are correctly aligned to allow the ring to expand. With section 24 fully in position, tubular section 26 is driven into tubular section 24, shearing the pins 28 and causing split ring 44 to expand fully into the depth of recess 46, whereby thread 42 ratchets over the thread on the split ring. In this manner the overall axial length of hanger 14 is adjusted to close to the final length required to match properly the distance between casing 12 and surface wellhead 10.

Torque tool 40 is now disengaged from drive socket 62 in section 24 and is, instead, engaged with drive socket 64 which is provided on the inner upper surface of section 26. Thus engaged, tool 40 is used to rotate section 26. Split ring 44 is prevented from rotating by one or more keys 66, with the result that ring 44 is drawn axially upwards upon rotation of section 26. This has the effect of moving hollows 50 and 56 out of their previous relative alignment such that it is no longer possible for the split ring to expand. Thus, thread 42 can not then ratchet over the threaded surface of split ring 44. Split ring 44 abuts the upper axial end of recess 46 and tension can thereby be drawn in the tubular section 24, 26 and casing 12, whereby hanger 14 and casing 12 can be tied back to surface wellhead 10. Casing hanger 22 is engaged with section 26 and a conventional pack-off 16 is used to hold the two relative to wellhead housing 18. Thus, it will be appreciated that this arrangement completely avoids the disadvantage of the conventional tie-back technique which requires cutting and dressing of the casing.

With sections 24 and 26 held their final positions relative to each other, torque tool 40 is engaged with drive socket 68 which is provided in the internal cyclindrical surface of ferrule 32. Tool 40 is used to rotate ferrule 32 relative to section 26 such that thread 34 draws ferrule 32 axially toward section 26. This upward movement of ferrule 32 32 causes the conical upper rim 70 of the ferrule to be driven into seal 36, thus splaying the seal and forcing it tight between sections 24 and 26. This forms a fluid tight seal.

Rotational setting of the hanger has been described. This is advantageous for achieving an accurate predetermined loading in a tie-back system. However, in some circumstances it may be acceptable for the hanger to be set, after landing and pack off, simply by pulling the lower section upwards. Activation of the hanger joint can be mechanical or hydraulic. Mechanically by locking into the outer tubular section and pulling up, with subsequent locking into the inner tubular section and rotating. Hydraulically by locking and sealing into the outer tubular section and pressurising the string below the setting tool.

Figure 4:
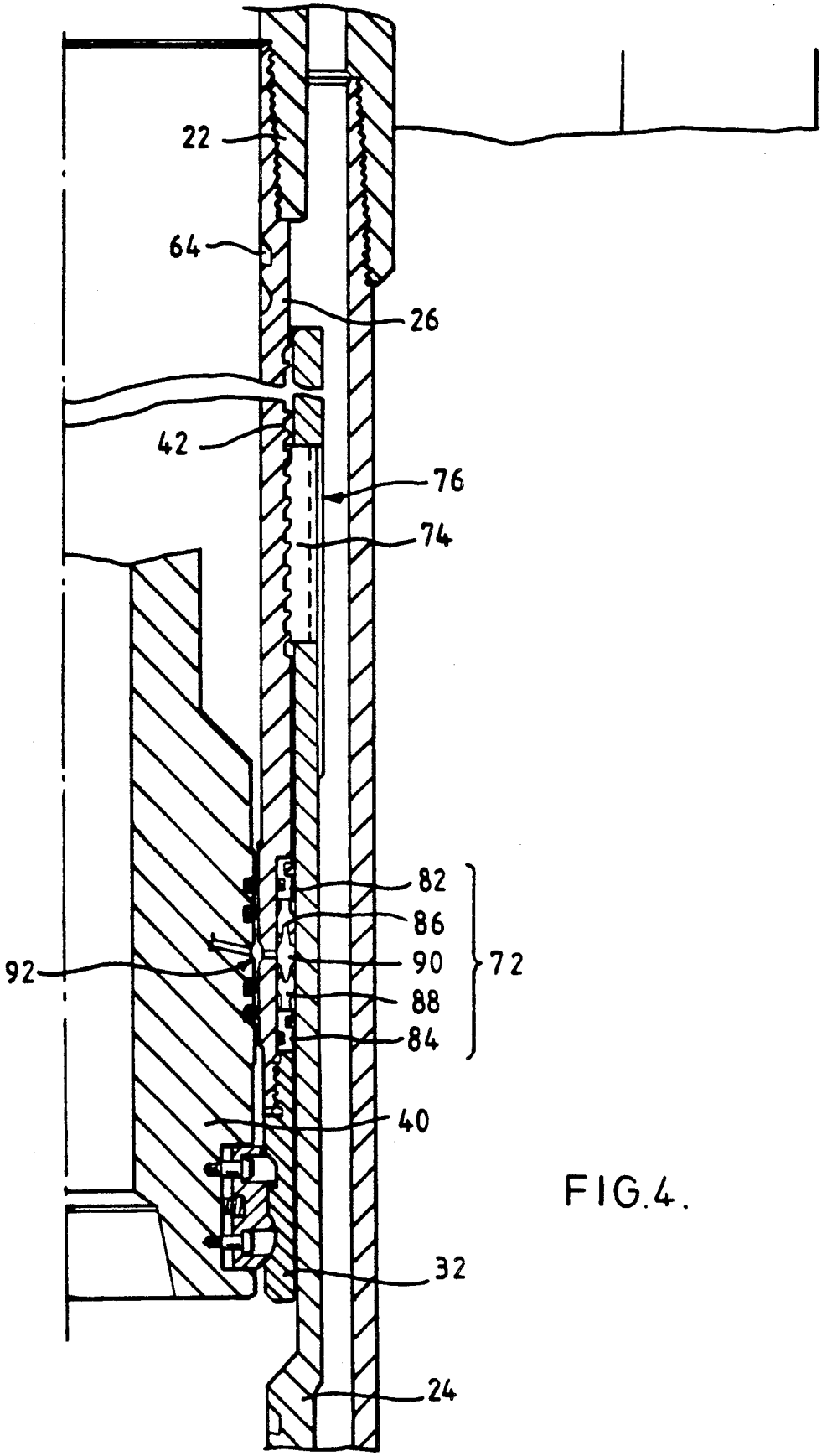
FIG. 4 is a view similar to FIG. 2, but showing an alternative embodiment of the invention.
Figure 5:
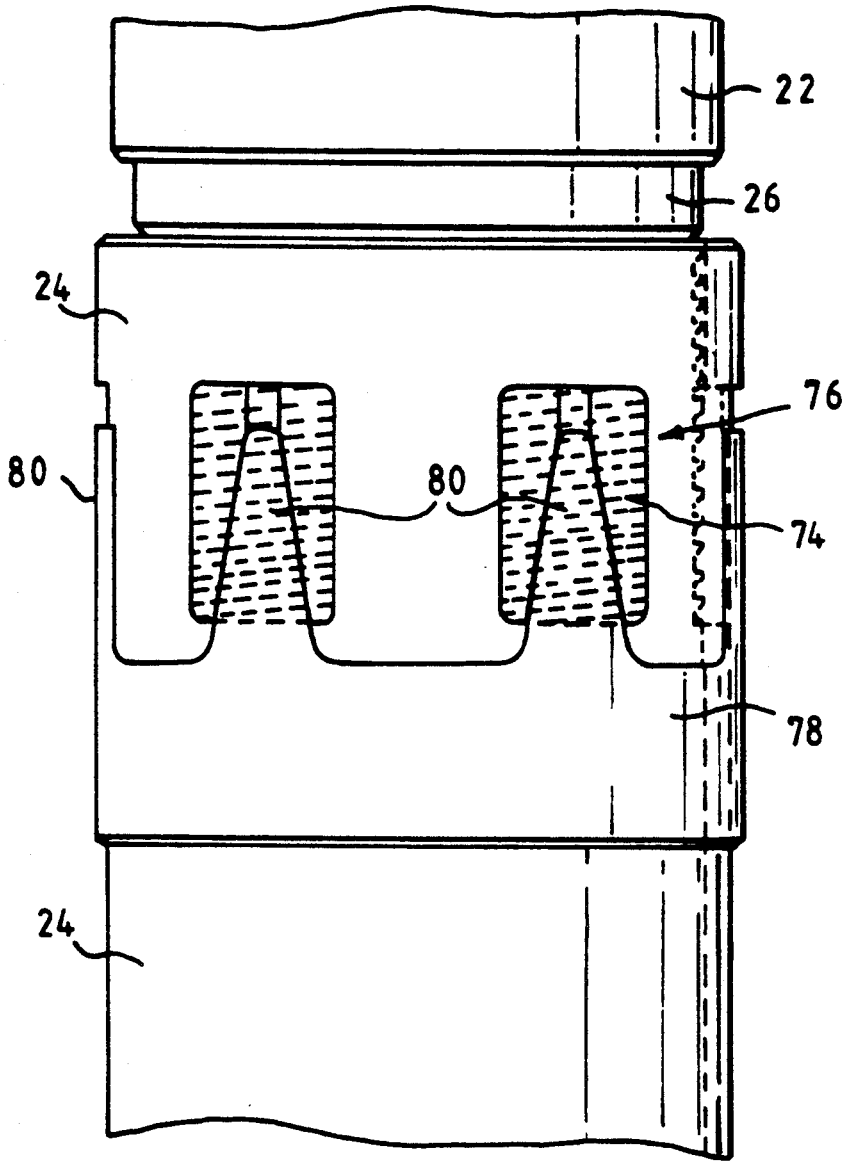
FIG. 5 is a partial external view, to an enlarged scale, of the arrangement shown in FIG. 4.

FIGS. 4 and 5 illustrate another embodiment of the present invention. FIG. 4 generally corresponds to FIG. 2 and, where appropriate, the same reference numerals have been used. Of course, these reference numerals are also used in FIG. 5.

In FIG. 4, the inner tubular section 26 is essentially the same as in FIG. 2. The detail of ferrule 32 is somewhat modified in the embodiment of FIG. 4 and seal 36 is replaced by a seal assembly 72. The configuration of the outer tubular section 24 is basically the same in the two embodiments, with the exception of the area in which the detent is retained. Indeed, the essential difference between the two embodiments is that the split ring 44 is replaced by an alternative detent arrangement.

In the embodiment of the invention shown in FIGS. 4 and 5, the inner tubular section 26 is adjustably coupled to outer tubular section 24 by six separate detents 74. Each detent 74 can be considered as a segment of split ring 44 of the previous embodiment. The outer tubular section 24 is not, however, provided with a circular recess 46, but instead each detent 74 is retained in a respective window 76 (of approximately 30° extent) which extends through the outer tubular section 24. Moreover, there is no significant axial difference in the extent of the detent 74 and the window 76. The complementary thread surface of the detents 74 is urged into contact with the serrated surface 42 of the inner tubular section 26 by the action of a retaining ring 78. Retaining ring 78 is slidably received on the external surface of the outer tubular member 24. The retaining ring 78 is provided with six axially extending lugs 80 each of which is secured to a respective detent 74. Retaining ring 78 is held in position relative to outer tubular member 24 by pins, a split ring or a similar arrangement.

Detents 74 are restrained to move radially of the hanger within their respective windows. They are prevented from moving fully out of the windows. The lugs 80 urge their respective detent 74 into engagement with thread 42 and owing to the shape of the thread, the inner and outer tubes are locked together by this arrangement upon the application of an axial load. Each lug 80 has a tapered profile in the axial direction on the curved surface of the outer tubular section. This profile ensures constant loading of the detent. That is, proper loading is achieved even if the loading is applied to the detent off-center.

Lugs 80 have an inherent resilience which urges the detents into contact with the serrated surface 42 of the inner tubular section 26. However, when the inner tubular section 26 is axially forced into the outer tubular section 24, detents 74 ride over the serrated surface 42 and the radially outward movement of the detents is accommodated by flexing of the lugs 80. Relative rotation between the inner and outer tubular sections is used, as in the previous embodiment, to effect fine adjustment of the overall axially length of the hanger. It will be apparent that no additional lockdown facility is provided with this second embodiment of the invention. The arrangement does, however, have a self lockdown achieved by the negative rake buttress thread. That is, as soon as the hanger is pulled in tension it self locks. A wicker type thread can also be used to achieve this function.

As mentioned above, in place of the seal 36 used in the first embodiment, a seal assembly 72 is provided in the embodiment of FIGS. 4 and 5. The seal assembly 72 comprises upper and lower seal carriers 82 and 84. The seal carriers act on responsive metal seals 86 and 88. Each of the metal seals 86 and 88 has a substantially Y-shaped cross-section, with the base thereof in contact with the respective seal carrier 82, 84. Between the seals 86 adn 88 is an expansor ring 90 which is shaped to seat in the central groove of the cross-section of seals 86 and 88. The arrangement is such that relative rotation between ferrule 32 and inner tubular section 26 results in the metal seals 86 and 88 being forced onto the expansor ring 90 which wedges the metal seals into contact with both the inner and outer tubular sections.

Seal assembly 72 allows for the integrity of the seal between the inner and outer tubular sections to be tested. This is achieved by way of a test port 92 which could, perhaps, be opened and operated by the running tool 40. Whether or not the high pressure of a test fluid applied via port 92 is retained indicates directly the integrity of the seal between the tubular sections.

If necessary, to obtain the required axial length several units each in accordance with the present invention can be used together in the same string.

Several embodiments of the invention have been described with reference to the accompanying drawings. However, it will be readily apparent to those skilled in art that various modifications can be made without departing from the scope of the invention. At the most basic level, serrated surface 42 could, of course, be provided on section 24 with recess 46 being provided in section 26.

What we claim is:

1. A hanger comprising two tubular sections, one partially received within the other in telescoping relationship, on section having a serrated surface facing the other of said sections, and the other section retaining detent means, said detent means comprising a plurality of segments, each of said segments received in a repsective aperture in said other section and having thread means thereon for cooperatively engaging said serrated surface to releasably secure said two tubular sections in a desired relative position, said thread means to be moved into and out of engagement with said serrated surface, whereby the axial length of said hanger is adjustable.

2. A hanger as claimed in claim 1, wherein said respective apertures are axially more extensive than the other means.

3. A hanger as claimed in claim 1, wherein the serrated surface is a thread.

4. A hanger as claimed in claim 1, wherein the tubular section received within the other section carries at its axially inner and a ferrule rotatable relative thereto and a seal, rotation of the ferrule causing the seal to seal between the tubular sections.

5. A hanger as claimed in claim 1, further including a retaining ring having a plurality of lugs, each said lug contacting a different one of said segments of said detent so as to urge said segments into engagement with said serrated surface.

6. A hanger as claimed in claim 5, wherein each said lug has a tapered profile in the axial direction and on the curved surface of said retaining ring.

* * * * *